US008281923B2

(12) United States Patent
Elenes

(10) Patent No.: US 8,281,923 B2
(45) Date of Patent: Oct. 9, 2012

(54) OPTICAL LENS CASE

(76) Inventor: Luis Elenes, Portland, OR (US)

( * ) Notice: Subject to any disclaimer, the term of this patent is extended or adjusted under 35 U.S.C. 154(b) by 156 days.

(21) Appl. No.: 12/968,635

(22) Filed: Dec. 15, 2010

(65) Prior Publication Data

US 2011/0139643 A1 Jun. 16, 2011

Related U.S. Application Data

(60) Provisional application No. 61/286,732, filed on Dec. 15, 2009.

(51) Int. Cl.
*B65D 85/38* (2006.01)

(52) U.S. Cl. ..... 206/316.2; 206/585; 206/523; 206/592

(58) Field of Classification Search ..... 206/3, 433, 206/585, 316.2, 523, 591, 592, 594; 220/378, 220/495.06
See application file for complete search history.

(56) References Cited

U.S. PATENT DOCUMENTS

| | | | | | |
|---|---|---|---|---|---|
| 2,458,737 | A * | 1/1949 | Salkowitz | 229/90 |
| 3,401,791 | A * | 9/1968 | Stott et al. | 206/204 |
| 3,411,655 | A * | 11/1968 | Gaines | 220/582 |
| 3,531,644 | A * | 9/1970 | Koster | 250/507.1 |
| 3,819,081 | A * | 6/1974 | Runte | 220/23.87 |
| 4,279,339 | A * | 7/1981 | Gotter | 206/3 |
| 4,964,529 | A * | 10/1990 | Houston | 206/523 |
| 5,779,031 | A * | 7/1998 | Moraine et al. | 206/3 |
| 2008/0000781 | A1 * | 1/2008 | Noel Du Payrat et al. | 206/3 |

OTHER PUBLICATIONS

Pearstone, "Pearstone Onyx 40 Lens Case", accessible at Pearstone website: http://www.pearstone.com/detail?sku=572729. Accessed Aug. 23, 2011.
AquaTech, "Aquatech Lens Wraps", accessible at Aquatech website: http://www.aquatech.net/Lens-Soft-Wrap-ASWLL.php. Accessed Aug. 23, 2011.
Canon, "Canon lens case LX1324", accessible at B&H Photo website: http://www.bhphotovideo.com/c/product/164010-REG/Canon_2794A001_LZ1324_Lens_Case.html, Accessed Aug. 23, 2011.
Canon, "Canon lens case 600", accessible at B&H Photo website: http://www.bhphotovideo.com/c/product/186971-REG/Canon_2804A002_Lens_Case_600.html, Accessed Aug. 23, 2011.
Clik Elite, "Clik Elite CE202GR Lens Holster", accessible at B&H Photo website: http://www.bhphotovideo.com/c/product/629718-REG/Clik_Elite_CE202GR_CE202GR_Lens_Holster_Large.html, Accessed Aug. 23, 2011.
F.64, "f.64 LP Lens Pouch" accessible at B&H Photo website: http://www.bhphotovideo.com/c/product/17469-REG/f_64_LP_LP_Lens_Pouch.html, Accessed Aug. 23, 2011.

(Continued)

*Primary Examiner* — David Fidei
(74) *Attorney, Agent, or Firm* — Mohr Intellectual Property Law Solutions, PC

(57) ABSTRACT

An apparatus for receiving and protecting interchangeable camera lenses which includes a cylindrical body shell, having an outer rigid casing with inner and outer diameters, and having an inner soft-lined receptacle within the inner diameter of the body shell for receiving the camera lens; a base end cap; a ringed shaped mouth member having inner and outer diameters; a lid cap assembly; a first visco-elastic material bonded to the lid cap assembly; a second visco-elastic material bonded to the base end cap; and, the first and second visco-elastic materials conform to the shape of the lens when the lid cap assembly is engaged with the mouth member.

20 Claims, 4 Drawing Sheets

OTHER PUBLICATIONS

Lightware, "Lightware Long Lens Tube LT300" accessible at B&H Photo website: http://www.bhphotovideo.com/c/product/357506-REG/Lightware_LT300_Long_Lens_Tube_LT300.html, Accessed Aug. 23, 2011.

Lowepro, "Loweprp Lens Case 13×32cm", accessible at B&H Photo website: http://www.bhphotovideo.com/c/product/752417-REG/Lowepro_LP36307_PAM_Lens_Case_13_x.html, Accessed Aug. 23, 2011.

Mamiya, "Mamiya 210-295 Trunk Case", accessible at B&H Photo website: http://www.bhphotovideo.com/c/product/238172-REG/Mamiya_210_295_210_295_Trunk_Case.html, Accessed Aug. 23, 2011.

Nikon, "Nikon CL-38 Hard Lens Case", accessible at B&H Photo website:http://www.bhphotovideo.com/c/product/37240-REG/Nikon_4471_CL_38_Hard_Lens_Case.html, Accessed Aug. 23, 2011.

Tamrac, "Tamrac MX5378 MAS Lens Case", accessible at B&H Photo website:http://www.bhphotovideo.com/c/product/198712-REG/Tamrac_MX537801_MX5378_M_A_S_Lens_Case.html, Accessed Aug. 23, 2011.

Pelican, "Pelican 1564 Waterproof 1560 Case with Dividers", accessible at B&H Photo website: http://www.bhphotovideo.com/c/product/388345-REG/Pelican_1560_004_110_1564_Waterproof_1560_Case.html, accessed Aug. 23, 2011.

HPRC, "HPRC4050F Waterproof Hard Case", accessible at B&H Photo website: http://www.bhphotovideo.com/c/product/746131-REG/HPRC_HPRC4050FBLACK_HPRC4050F_Waterproof_Hard_Case.html, accessed Aug. 23, 2011.

HPRC, "HPRC4100F Waterproof Hard Case", accessible at B&H Photo website:http://www.bhphotovideo.com/c/product/746150-REG/HPRC_HPRC4100FBLACK_HPRC4100F_Waterproof_Hard_Case.html, accessed Aug. 23, 2011.

SKB, "SKB 31/1209-4B-L Mil-Std Waterproof Case 4" Deep", accessible at B&H Photo website: http://www.bhphotovideo.com/c/product/468715-REG/SKB_3l_1209_4B_L_3l_1209_4B_L_Mil_Std_Waterproof_Case.html, accessed Aug. 23, 2011.

* cited by examiner

OPTICAL LENS CASE

CROSS REFERENCE TO RELATED APPLICATIONS

The present application is a Non-Provisional of and claims the benefit of priority to U.S. Provisional application No. 61/286,732, filed on Dec. 15, 2009. The disclosures of both applications are hereby incorporated by reference.

BACKGROUND

1. Field of the Invention

The present invention generally relates to the field of containers for carrying cameras, optical lenses, and other photographic equipment. More particularly, the present invention relates to an interchangeable lens canister that affords protection against high impacts, high static force loads, extreme environmental temperatures, and water penetration.

2. Description of the Related Art

Photographic cameras that support interchangeable lenses are the most common used among professional and semi-professional photographers. The ability to change the optical lens mounted to the camera body simply and quickly is the key to the utility of the interchangeable lens/camera system. Because a particular photographic task may require a particular photographic lens design, the user (photographer) can easily change the optical lens of the camera unit to best satisfy the optical requirement for the particular photographic task. Effectively, the interchangeable lens camera system allows the photographer to be able to meet a wide array of photographic tasks with a single camera body (and the correct interchangeable lens unit) as opposed to multiple cameras with fixed lens designs.

Due to the high utility provided by interchangeable lens camera systems, most photographers carry a single camera body and multiple interchangeable lens units to meet a wide array of photographic tasks. It is typical for the advanced photographer to have more money invested in interchangeable lenses than in the individual camera body, since typically camera bodies are replaced or upgraded while optical lenses are kept to meet future photographic needs.

Many camera case designs exist to carry and protect the camera unit and its mounted camera lens. Cases designed to carry individual (unmounted) camera lenses also exist. Most lens cases are either a) rectangular in shape, and/or b) composed of soft or semi-rigid material. Very few lens cases offer protection against high impacts, high static force loads, extreme environmental temperatures, and/or water penetration.

Typically, photographers carry their complete photo kit (camera body, multiple lenses, electronic accessories, etc.) in one large dedicated protective bag or hard case. This system works well in protecting all equipment simultaneously and equally. The downsides to this method for transporting equipment are a) the case or bag makes compromises in protecting each individual piece of equipment, b) it is difficult to make large "photographic" style bags subtle and low-key, c) carrying a large photographic bag prevents the user from carrying other required gear, d) photographic bags may not be adequate for transporting other equipment since they are specialized for a single purpose.

There are many photographers who must be able to carry other equipment into the field. This type of user may include outdoor, adventure, travel, and/or journalistic photographers to name a few. For these users, carrying a large, single-function camera bag is not an option. While on assignment, these users must be able to carry and protect a few pieces of photo equipment (mainly a camera body and spare lenses) and other non-photo related equipment in a single bag (backpack, luggage, or similar) designed for multiple purposes, not uniquely designed to transport and protect photographic equipment. These types of photographers do not have the luxury of needing to carry only photo equipment, and thus must accommodate professional and personal gear in their personal luggage.

A dedicated rigid interchangeable lens case allows the photographer to carry a spare interchangeable lens in a single small well-protected package. With a dedicated spare interchangeable lens case, the photographer can have the choice to carry as few or as many interchangeable lenses as they desire. This, in turn, allows the photographer to carry any necessary amount of luggage, rather than a single large photo bag.

Depending on the size of each lens and the size of the interchangeable lens case, either multiple lenses can be stored in a single interchangeable lens case or each lens can be transported in individual smaller interchangeable lens cases. The rigid interchangeable lens case (with lens) can then be stored in personal baggage that does not have to be designed or dedicated to protecting and transporting photographic equipment, thus allowing the user to have more flexibility in baggage and equipment selection. With this dedicated lens case approach the photographer can carry only the protective case(s) he or she needs in a non-dedicated photo bag, yet not compromise on protection of the interchangeable lens unit(s).

Lens cases relevant to this disclosure are discussed in the following U.S. patents, which are hereby incorporated by reference: U.S. Pat. Nos. 4,172,485; 4,177,894; 4,383,565; 4,549,589; 5,199,563; and 5,373,980.

BRIEF DESCRIPTION OF THE DRAWINGS

Many aspects of the present invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Non-limiting embodiments of the present invention utilize a lens case that is especially suited to transport and protect optical photographic lenses of various sizes and configurations and provide an alternative to carrying optical lenses in a large semi-rigid or soft dedicated photography bag. The lens case is waterproof and further provides a very high level of protection of its contents from environmental temperatures. In addition, the lens case is designed to protect against static force loads, cushion the lens against impacts, resist high impacts, and prevent unintentional opening of the lens case during its transport or storage.

Figure 1:
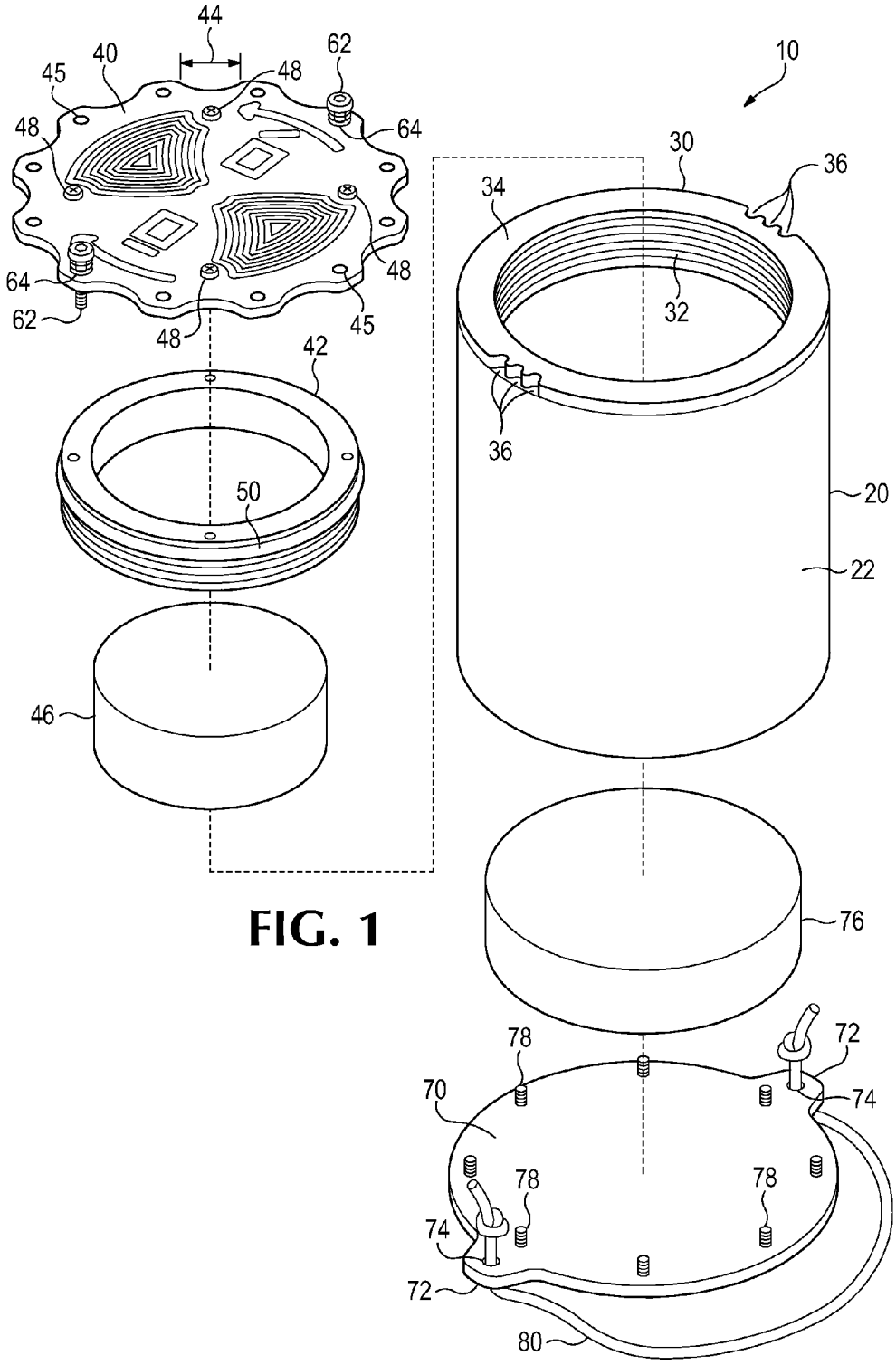
FIG. 1 is an exploded, perspective front view of the lens case constructed according to the teachings of the present invention.

Referring to the drawings, wherein like reference numerals represent like parts throughout the various drawing figures, FIG. 1 is directed to a lens case or canister 10. The lens case 10 has a body shell 20, a ring-shaped mouth member 30, a lid cap assembly 40, gasket 50, lid lock assembly 60, base end cap 70, and strap 80.

Figure 5:
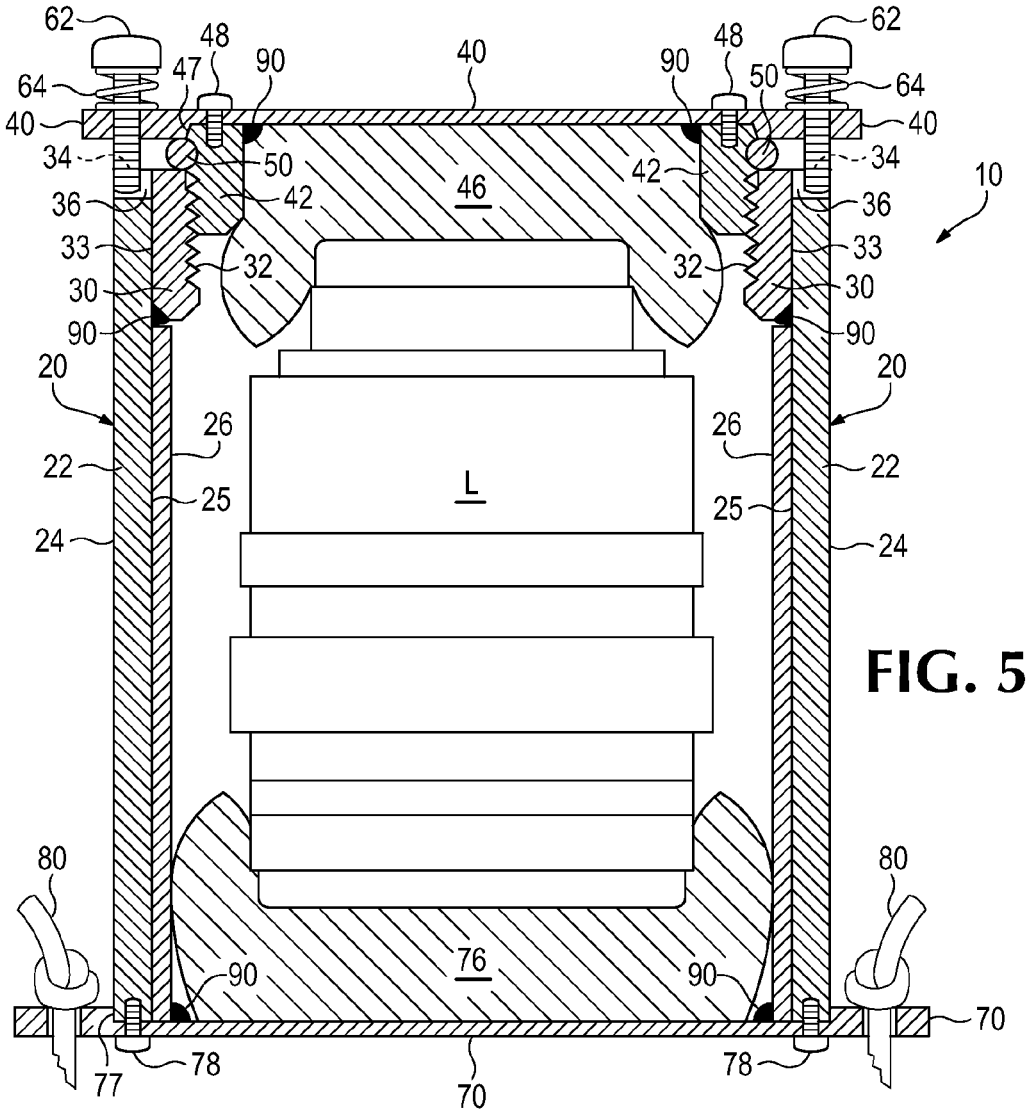
FIG. 5 is a side plan, cross-sectional view of the lens case shown in FIG. 1.
Figure 6:
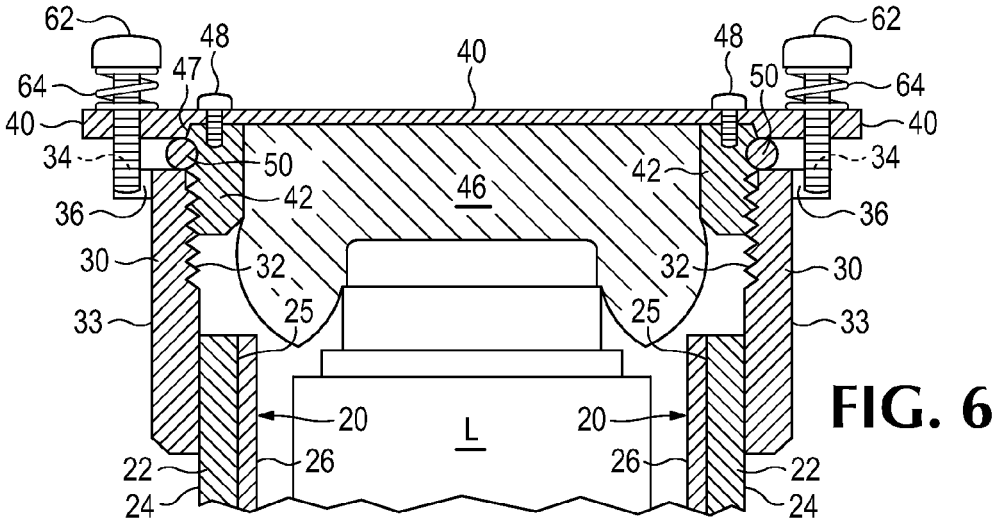
FIG. 6 is a side plan, cross-sectional view of a non-limiting embodiment of the lens case.

With reference to FIGS. 5 and 6 and continuing reference to FIG. 1, body shell 20 is a cylindrical-tubing canister that has an outer rigid casing 22 and inner liner 26. Outer rigid casing 22 has external surface 24 and internal surface 25. Outer rigid casing 22 can be constructed from a cylindrical ABS tube that is cut to length to accommodate interchangeable lenses L with variable external lengths and external diameters. Various internal cavity diameters of the outer rigid case ranging from about 3 to about 4 inches can be used to accommodate lenses with complementary external diameters. In this disclosure, the external diameter of the lens is referred to as a lens diameter.

It should be understood by one of ordinary skill in the art that the outer rigid casing 22 can be constructed from any other suitable rigid material that is durable, tough, water-resistant, and relatively lightweight. Such materials include, but are not limited to, injection molded plastic, carbon fiber resin, or other metal or non-metallic alloy.

External surface 24 and the internal surface 25 of the outer rigid casing 22, as well as the inner liner 26 are shown, in the non-limiting configurations of FIGS. 5-6. In the example shown in FIGS. 5 and 6, inner liner 26 extends from mouth member 30 to base end cap 70 Grit-impregnated synthetic self-adhesive tape (not shown) may be attached to the external surface 24 to provide a firm grip of the lens canister 10. Those of skill in the art will appreciate that any suitable material alternative is contemplated as being within the spirit and scope of the invention.

With continuing reference to FIGS. 5 and 6, inner liner 26 abuts internal surface 25 to form a soft-lined receptacle in which to receive the lens L. The inner liner 26 can be made from a thin, soft, and durable material, such as, but not limited to, Neoprene®. The inner liner 26 protects the external surface of the transported interchangeable lens L from damage upon entry into and exit from the lens case 10. Inner liner 26 may also assist in dampening impacts to the lens case 10 during transport or storage. However, in some examples, such as shown in FIGS. 5 and 6, the inner liner may not contact the lens when the lens is stored in the lens case, but instead the lens case may provide for a gap of air around the lens for at least a portion of the height of the lens. The inner liner 26 may be removable for cleaning or replacement.

Referring back to FIG. 1, mouth member 30 is ring-shaped and constructed from injection molded and machined acrylic plastic. Those of skill in the art will appreciate that any suitable material alternative is contemplated as being within the spirit and scope of the invention. The mouth member 30 has grooves 32, a flange 34 and stop notches 36. The ring-shaped mouth member 30 is permanently bonded via epoxy 90 or cement 90 (See FIGS. 5 and 6) to the outer rigid casing 22, as shown in FIG. 1. A permanent adhesive bond with epoxy 90 or cement 90 is used to guarantee a water-tight seal, as well as to ensure a robust structure of the lens case 10.

In FIGS. 5 and 6, outer diameter 33 of the mouth member 30 is illustrated. The mouth member 30 at outer diameter 33 can be bonded to the internal surface 25 of the outer rigid casing 22, as shown in FIG. 5. Alternatively, in a non-limiting embodiment, the outer diameter 33 of the mouth member 30 can be bonded to the external surface 24 of the outer rigid casing 22 of the body shell 20, as shown in FIG. 6. Smaller in external diameter interchangeable lenses L will be suited for the embodiment of FIG. 6 with the mouth member 30 adhesively bonded to the external surface 24 of the outer rigid casing 22, while a lens L with a longer external diameter can be used for the embodiment as represented in FIGS. 1-5.

Figure 2:
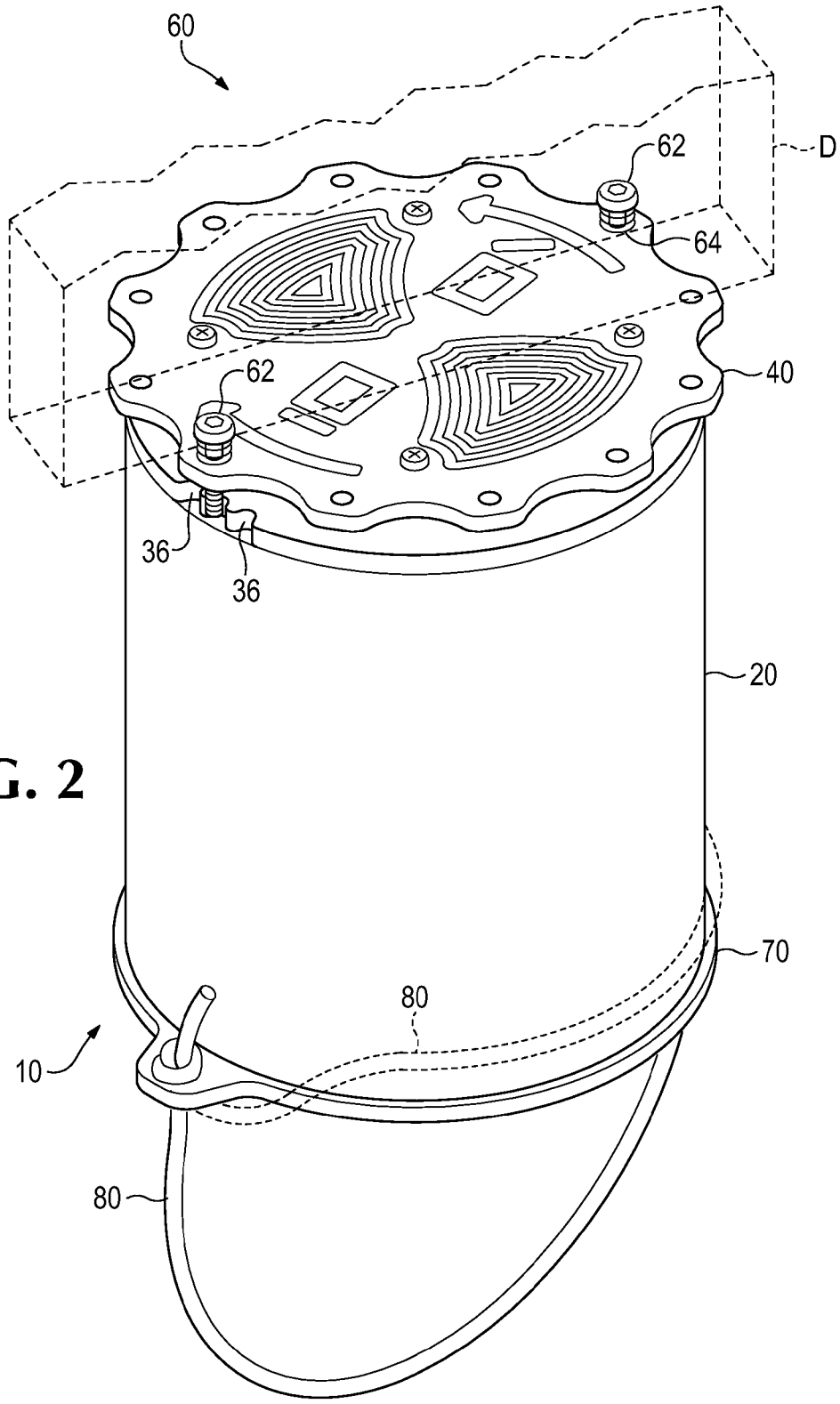
FIG. 2 is a perspective front view of the lens case shown in FIG. 1.
Figure 3:
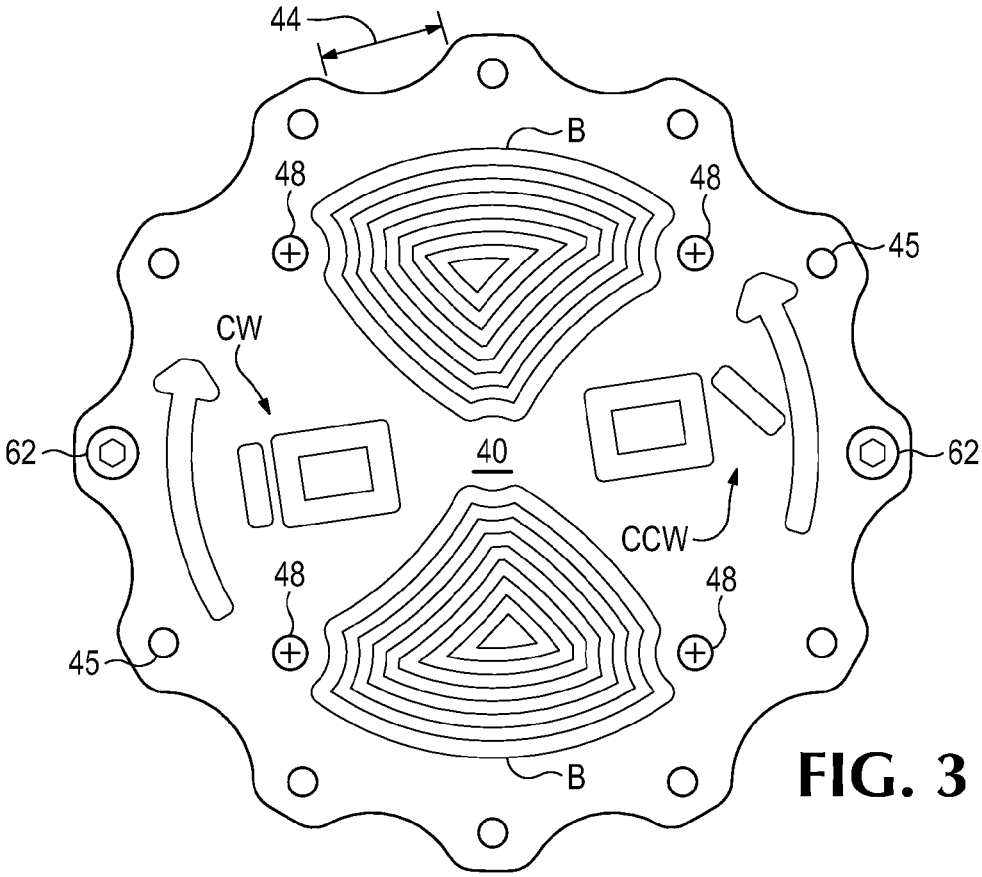
FIG. 3 is a top plan view of the lens case shown in FIG. 1.

Referring to FIGS. 1, 2 and 3, the lens canister 10 includes a lid cap assembly 40. The lid cap assembly 40 has a thread ring 42, cut-outs 44, holes 45, visco-elastic material 46, and fasteners 48. The lid cap assembly 40 is machined from a plastic material, in particular 0.25 inch thick ABS sheet, and has a disk-like circular shape. The lid cap assembly may be formed from a variety of other materials in different examples, such as other types of plastic, metals, or ceramics. The perimeter of the lid cap assembly 40 has semi-circular cut-outs 44 that enable a user to easily rotate the lid cap assembly 40 when closing or opening the lens case 10.

In addition, the top side of the lid cap assembly 40 may employ various machined markings or etchings B, CW, and CCW. In a non-limiting embodiment of FIG. 3, markings B define a concentric pattern that increases the friction available for a user's finger to engage and manipulate the lid cap assembly, marking CW with arrow designates the functional rotation direction to close the lid case 10, and marking CCW with arrow designates the functional rotation direction for opening the lens case 10. Additional and alternative markings may be used for product branding, as shown in a non-limiting embodiment of FIG. 4.

The thread ring 42 of the lid cap assembly 40 is constructed from injection molded and machined acrylic plastic. Those of skill in the art will appreciate that any suitable material alternative is contemplated as being within the spirit and scope of the invention. The underside of the lid cap assembly has a circular pocket 47 to accommodate the bonding and assembly of the thread ring 42.

The lid cap assembly 40 including the thread ring 42 are permanently bonded with epoxy 90 and reinforced with fasteners 48. In a non-limiting embodiment, the fasteners 48 in FIGS. 1-6 are stainless steel screws. It should be understood by one of ordinary skill in the art that fasteners 48 can any other suitable material used to reinforce the types of materials used in the present invention.

Referring to FIGS. 5 and 6 and with continuing reference to FIG. 1, gasket 50 is illustrated. The gasket 50 may be an O-Ring made from EPDM rubber. Those of skill in the art will appreciate that any suitable material alternative is contemplated as being within the spirit and scope of the invention. Thread ring 42 may be slotted such that the gasket 50 is stationary to the thread ring 42. The gasket 50 ensures that a water and air-tight seal is formed within the rigid lens case 10 when the thread ring 42 of the lid cap assembly 40 is engaged with the grooves 32 of the mouth member 30.

When the lid cap assembly 40 is engaged with the mouth member 30, the lid cap assembly 40 may be rotated to the closed position, compressing the gasket 50 against the external surfaces of the lid cap assembly 40 and the mouth member 30, as shown in FIG. 2. The threaded interface between the lid cap assembly 40 and the mouth member 30 provides a rotational interference fit allowing the user to open and close the lens case 10 using a twisting motion. A clockwise (CW) direction closes the case, and a counterclockwise (CCW) direction opens the case.

The mouth member 30 captures the lid cap assembly 40 with a rotational motion provided by the user. As the user rotates the lid cap assembly 30 clockwise, the lid cap assembly 30 will translate downward, towards the body shell 20 until the gasket 50 is adequately compressed and the lens case 10 is closed. The flange 34 provides a smooth surface for the gasket 50 to sit and seal, via compression from the downward translation of lid cap assembly 30. As a result, a water-proof seal between the interior and exterior of the lens case 10 is created.

With continuing reference to FIG. 2, the lens case 10 provides a high level of protection to optical lenses L from the ambient environment that exceeds existing soft or semi-rigid cases. The types of protection provided include water and moisture penetration, and thermal temperature changes.

Referring to FIGS. 1, 2, 3, 5, and 6, the lid lock assembly 60 is composed of a pair of socket head machine screws 62 and compression springs 64. The machine screws 62 are threaded thru the lid cap assembly 40. Once the lid cap assembly 40 is rotated clockwise and the lens case 10 is closed, the machine screws 62 are then twisted clockwise to engage the matting set of stop notches 36 on the flange 34 of the mouth member 30. The stop notches are recessed portions cut out of the flange 34 such that the periphery of the ring shaped mouth member 30 is not truly annular. Each set of the stop notches 36 is positioned 180 degrees from the other set 36.

With the machines screws 62 acting as biasing members and engaged into the stop notches 36, the lid cap assembly 40 is restricted or prevented from rotating in a counter clockwise direction, thus locking the lid cap assembly 40 in the closed position. Compression springs 64 are mounted axially around the body of the machine screw 62, applying a load on the back side of the head of the machine screw 62. As a result, the springs 64 prevent the screws 62 from backing out and off from the lid assembly 40.

In non-limiting embodiment of FIG. 2, the lid lock assembly 60 can be used to aid in removing an overly tightened or jammed lid cap assembly 40, when pressure and temperature changes make opening the lens case 10 more difficult. A can be seen in FIG. 2, machine screws 62 are spaced and offset from a line extending between them. Offset in this context means that machine screws 62 are on opposite lateral sides of the imaginary line extending between them.

As shown in FIG. 2, rotational leverage can be gained to help unscrew an overly tight, air-locked, or jammed lid cap assembly 40 by wedging a sturdy straight edge or fixture D, such as the end of a desktop or table top the machine screws 62, between the edges of machine screws 62. Expressed another way, machine screws 62 are positioned to receive and cooperatively abut on opposing lateral sides a straight edge extending along the line between them to provide rotational leverage for removably engaging the lid cap assembly. The lid lock assembly 60 is also designed such that it can easily be removed by the user if desired.

Referring to FIGS. 1, 2, 4, and 5, the base end cap 70 is illustrated. The base end cap 70 is constructed from machined 5052 aluminum plate, ABS, or acrylic materials, and has a disk like circular shape. Base end cap 70 forms a closed-end, floor with the body shell 20. The perimeter of the base end cap 70 is circular with the exception of two protruding tabs 72 that enable the user to get a better grasp of the lens canister 10 when removing or replacing the lid cap assembly 40. Through holes 74 serve as attachment points to strap 80 (described below).

Figure 4:
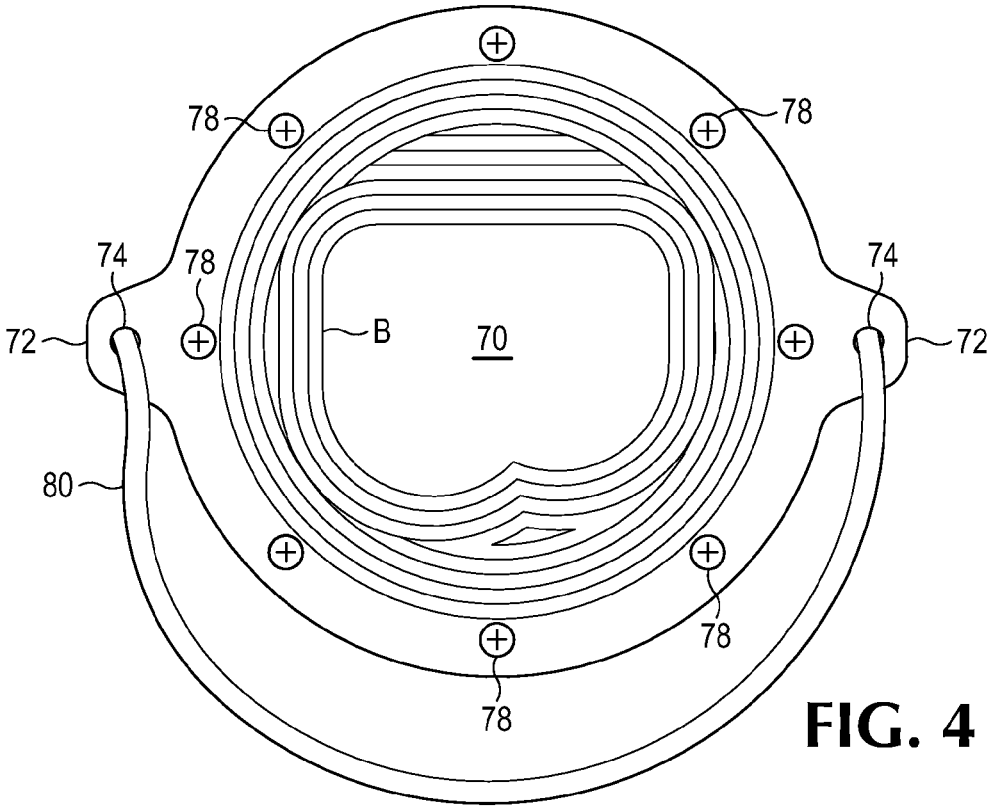
FIG. 4 is a bottom plan view of the lens case shown in FIG. 1.

Similar to the lid cap assembly 40, the external surface of the base end cap 70 may include various machined markings B, as shown in FIG. 4. The internal side of the base end cap has a circular pocket 77 to accommodate the bonding and assembly to the body shell 20. The base end cap 70 is permanently adhesively bonded to the body shell 20 with epoxy 90 and additionally fixed with fasteners 78, such as stainless steel screws. The protruding heads of the fasteners 78 also help protect the external surface of the base end cap 70.

Referring to FIGS. 1 and 5, both the lid cap assembly 40 and the base end cap 70 include visco-elastic material or polyurethane foam, conventionally known as memory foam. In FIGS. 1 and 5, visco-elastic material 46 is bonded to the lid cap assembly 40 and visco-elastic material 76 is bonded to the base end cap 70. Both visco-elastic materials 46 and 76 perform the same function, and have the same purpose. The correct thickness sizing of visco-elastic materials 46 and 76 is necessary to properly suspend an optical lens L in the rigid lens case 10.

In the examples shown in FIGS. 1 and 5, visco-elastic material 46 is selected to have a volume sufficient for portions it to extend into the gap around the lens a distance sufficient to fully overlie mouth member 30 when lid cap assembly 40 is mounted to body shell 20 and visco-elastic material 46 conforms to the shape of the lens. By partially extending into the gap, visco-elastic material 46 serves to retain the lens in a central position. By overlying mouth member 30, visco-elastic material 46 shields the lens from impact with mouth member 30.

By nature, the visco-elastic materials 46 and 76 are very compliant. Thus, a single foam thickness will cover a relatively large set of lens L dimension. In addition, for encasing optical lenses L that are shorter in length (See FIG. 5), additional visco-elastic materials, as well as additional foam disks of different densities are provided to the user. It should be appreciated by one of ordinary skill in the art that any extra foam material provided with the lens case 10 can include a different type of foam, such as closed cell polyethylene (not shown) to provide protection against impact and vibrations when used in conjunction with visco-elastic materials 46 and 76. When multiple types of foam are used in a layered series, there is combined advantage because the visco-elastic materials 46 and 76 grab and contour to the end of the lens L, while the more rigid polyurethane layer (not shown) provides more resilient damping against the transmission of large impacts.

The visco-elastic materials 46 and 76 are composed of a 1-2 inch thick circular piece of visco-elastic polyurethane foam. The properties of this specific type of polyurethane foam enable the carried lens L to be very well isolated from shock and vibrations applied to the lens case 10.

When the lens case 10 is completely closed, the soft visco-elastic materials 46 and 76 compress against and around the top and bottom end of the lens L. Both materials 46 and 76 mold to the external end shape of the stored optical lens L, thus suspending the lens L and preventing any lateral or side-to-side movement of the lens L within the case 10. Visco-elastic materials 46 and 76 alleviate the need for lens L manufacturers to include custom foam supports that are specifically made for their commercially available lenses L. The lateral sides of the lens L are held away from the sides of the lens case 10 where there is a higher likelihood of external impact forces or static loads. Also, placement and removal of the lens L in and out of lens case 10 is fast and easy, since the user does not have to be concerned with bulky foam padding or intrusive foam materials along the lateral sides of the lens case 10.

The visco-elastic materials 46 and 76 suspend the lens L at the lens' L strongest points (i.e., the front end of the lens L and the mounting point to the camera body), forming a pocket of air (not shown) around the outer surface of the lens L. The pocket of air further inhibits moisture from reaching the lens L because there is no material for moisture to wick through. Also, the pocket of air contributes positively to thermally insulating the lens L, since air is such a good insulator. Providing a pocket of air facilitates storing a wider variety of lens L, e.g. some lenses L may have projections or bulges along their length with which padding would interfere.

With reference to FIGS. 1, 2, 4, and 5, strap 80 is attached to the base end cap 70 at through holes 74. The strap 80 can be constructed of elastic or non-elastic cord. The strap 80 allows the user to more securely carry the lens case 10 by hand or remove the case 10 from a backpack or any other baggage with ease. The strap 80 can be stored in a configuration around the base end cap 70 when not in use, as shown by the phantom lines in FIG. 2.

In a non-limiting embodiment, the strap 80 may be stretched over (not shown) the lid cap assembly 40 to further compress the lid cap assembly 40 to the body shell 20. In this non-limiting embodiment, strap 80 extends taut along the length of the lens case when stretched over the top of the lid cap assembly 40 and can serve as a handle during transport.

From the foregoing description it will be apparent that modifications can be made to the protective lens case 10 without departing from the teachings of the invention.

The instant invention may be embodied in other forms or carried out in other ways without departing from the spirit or essential characteristics thereof. The present disclosure is therefore to be considered as in all respects illustrative and not restrictive, the scope of the invention being indicated by the appended claims, and all equivalency are intended to be embraced therein. One of ordinary skill in the art would be able to recognize equivalent embodiments of the instant invention and be able to practice such embodiments using the teaching of the instant disclosure and only routine experimentation.

What is claimed is:

1. An apparatus for receiving and protecting interchangeable camera lenses comprising:

a cylindrical body shell, the body shell including an outer rigid casing having inner and outer diameters, and an inner soft-lined receptacle within the inner diameter of the body shell for receiving a lens therein;

a base end cap adhesively bonded to the body shell, wherein the base end cap forms a closed-end floor with the body shell;

a ring-shaped mouth member having inner and outer diameters, wherein the outer diameter of the ring-shaped mouth member is adhesively bonded to the inner diameter of the outer rigid casing;

a lid cap assembly, removably engageable in a rotational interference fit with the mouth member; wherein the lid cap assembly and the mouth member are co-operable to form a seal;

a first visco-elastic material adhesively bonded to the lid cap assembly; and a second visco-elastic material adhesively bonded to the base end cap; wherein the first and second visco-elastic materials conform to the shape of the lens when the lid cap assembly is engaged with the mouth member.

2. The apparatus of claim 1, wherein the mouth member further comprises a periphery and recessed portions cut out of the periphery; the recessed portions being configured about 180 degrees from one another.

3. The apparatus of claim 2, wherein a pair of biasing members are configured to thread through the lid cap assembly and matingly engage with the recessed portions, the biasing members restricting the lid cap assembly from disengaging from the mouth member.

4. The apparatus of claim 3, wherein the biasing members are spaced and offset from a line extending between them to receive and cooperatively abut on opposing lateral sides a straight edge extending along the line to provide rotational leverage for removably engaging the lid cap assembly.

5. The apparatus of claim 1, further comprising a gasket adjacent and abutting the outer diameter of the mouth member.

6. The apparatus of claim 1, wherein the first visco-elastic material and the second visco-elastic material cooperatively suspend and cushion the lens therebetween.

7. An apparatus for receiving and protecting interchangeable camera lenses comprising:

a cylindrical body shell, the body shell including an outer rigid casing having inner and outer diameters and an inner soft-lined receptacle within the inner diameter of the body shell for receiving a lens therein;

a base end cap adhesively bonded to the body shell, wherein the base end cap forms a closed-end, floor with the body shell;

a ring-shaped mouth member having inner and outer diameters, wherein the inner diameter is adhesively bonded to the outer diameter of the outer rigid casing;

a lid cap assembly, removably engageable in a rotational interference fit with the mouth member; wherein the lid cap assembly and the mouth member are co-operable to form a seal;

a first visco-elastic material adhesively bonded to the lid cap assembly; and a second visco-elastic material adhesively bonded to the base end cap; wherein the first and second visco-elastic materials conform to the shape of the lens when the lid cap assembly is engaged with the mouth member.

8. The apparatus of claim 7, further comprising a combination of plural visco-elastic materials and plural closed cell polyethylene foams optionally layered between the first and the second visco-elastic materials or replacing the first and the second visco-elastic materials to more closely conform to the length of the lens.

9. The apparatus of claim 8, wherein a pair of biasing members are configured to thread through the lid cap assembly and matingly engage with the recessed portions, the biasing members restricting the lid cap assembly from disengaging from the mouth member.

10. The apparatus of claim 9, wherein the biasing members are spaced and offset from a line extending between them to receive and cooperatively abut on opposing lateral sides a straight edge extending along the line to provide rotational leverage for removably engaging the lid cap assembly.

11. The apparatus of claim 7, further comprising a gasket adjacent and abutting the outer diameter of the mouth member.

12. The apparatus of claim 7, wherein the first visco-elastic material and the second visco-elastic material cooperatively suspend and cushion the lens therebetween.

13. An apparatus for receiving and protecting interchangeable camera lenses comprising:

a cylindrical body shell including a rigid casing including an internal surface and defining a cylindrical cavity for receiving a lens having a lens diameter, the cylindrical cavity having a cavity diameter larger than the lens diameter to define a gap between the lens and the internal surface;

a base end cap adhesively bonded to the body shell, wherein the base end cap cooperates with the cylindrical body shell to form a floor of the cylindrical cavity;

a ring-shaped mouth member adhesively bonded to the internal surface of the rigid casing;

a lid cap assembly including a thread ring configured to removably engage the mouth member with a rotational interference fit; wherein the lid cap assembly and the mouth member are co-operable to form a seal and to form a roof of the cylindrical cavity;

a first visco-elastic material adhesively bonded to the lid cap assembly in an internal aperture defined by the thread ring;

a second visco-elastic material adhesively bonded to the base end cap;

wherein when the lid cap assembly is mounted to the cylindrical body shell, the first and second visco-elastic materials conform to the shape of the lens and extend into the gap between the lens and the internal surface to inhibit the lens from contacting the internal surface and to form an air pocket in the gap between the internal surface, the lens, the first visco-elastic material, and the second visco-elastic material.

14. The apparatus of claim 13, wherein the mouth member further comprises a periphery and recessed portions cut out of the periphery; the recessed portions being configured about 180 degrees from one another.

15. The apparatus of claim 14, wherein a pair of biasing members are configured to thread through the lid cap assembly and matingly engage with the recessed portions, the biasing members restricting the lid cap assembly from disengaging from the mouth member.

16. The apparatus of claim 13, wherein the first visco-elastic material is selected to have a volume sufficient for portions of the first-visco-elastic material to extend into the gap around the lens a distance sufficient to fully overlie the mouth member when the lid cap assembly is mounted to the cylindrical body shell and the first visco-elastic material conforms to the shape of the lens.

17. The apparatus of claim 13, further comprising an inner liner extending from the mouth member to the base end cap.

18. The apparatus of claim 13, wherein the lid cap assembly defines etchings defining indicia communicating instructions for opening and closing the lid assembly.

19. The apparatus of claim 18, wherein the lid cap assembly further defines a pattern of concentric etchings providing increased friction.

20. The apparatus of claim 13, wherein the lid cap assembly defines a plurality of peripheral cut outs configured to receive a user's finger.

* * * * *